US011780054B2

(12) United States Patent
Chen et al.

(10) Patent No.: US 11,780,054 B2
(45) Date of Patent: Oct. 10, 2023

(54) CUTTING METHOD BY USING PARTICLE BEAM OF METALLIC GLASS

(71) Applicants: Kuan-Wei Chen, Tainan (TW); Kuan-Yu Chen, Tainan (TW)

(72) Inventors: Kuan-Wei Chen, Tainan (TW); Kuan-Yu Chen, Tainan (TW)

(73) Assignee: TAICHI METAL MATERIAL TECHNOLOGY CO., LTD., Tainan (TW)

( * ) Notice: Subject to any disclaimer, the term of this patent is extended or adjusted under 35 U.S.C. 154(b) by 21 days.

(21) Appl. No.: 17/405,043

(22) Filed: Aug. 18, 2021

(65) Prior Publication Data

US 2023/0054463 A1 Feb. 23, 2023

(51) Int. Cl.

| | |
|---|---|
| ***B24C 11/00*** | (2006.01) |
| ***B24C 1/04*** | (2006.01) |
| ***B24C 5/08*** | (2006.01) |
| ***B24C 5/06*** | (2006.01) |
| ***B24C 3/32*** | (2006.01) |

(52) U.S. Cl.

CPC ..... *B24C 11/00* (2013.01); *B24C 1/045* (2013.01); *B24C 3/322* (2013.01); *B24C 5/062* (2013.01); *B24C 5/08* (2013.01)

(58) Field of Classification Search

CPC ..... B24C 11/00; B24C 1/045; B24C 3/322; B24C 5/062; B24C 5/08

USPC ..... 451/38

See application file for complete search history.

(56) References Cited

U.S. PATENT DOCUMENTS

| | | | | |
|---|---|---|---|---|
| 3,693,302 | A * | 9/1972 | Hakes | H01L 21/67092 451/31 |
| 6,508,693 | B1 * | 1/2003 | Bouten | H01L 21/0334 451/38 |
| 7,121,925 | B2 * | 10/2006 | Hashimura | H01L 21/3081 257/E21.232 |
| 2003/0224704 | A1 * | 12/2003 | Shank | B24C 1/086 451/38 |
| 2014/0308456 | A1 * | 10/2014 | Guan | G01N 15/0227 118/624 |
| 2019/0202029 | A1 * | 7/2019 | Inoue | B24C 1/045 |
| 2020/0063226 | A1 * | 2/2020 | Chen | B22F 1/05 |

* cited by examiner

*Primary Examiner* — Don M Anderson
*Assistant Examiner* — Jason Khalil Hawkins

(57) ABSTRACT

A cutting method by applying a particle beam of metallic glass onto a substrate to cut or partially cut the substrate with high production efficiency, low production cost and better environmental protection.

4 Claims, 4 Drawing Sheets

CUTTING METHOD BY USING PARTICLE BEAM OF METALLIC GLASS

BACKGROUND OF THE INVENTION

A conventional shot peening may be applied to process or cut a substrate by using steel balls, ceramic balls or carborundum particles. However, such a conventional peening method has the following drawbacks:

1. The peening ball or particle has low hardness, low density and acute angles, which may cause breakage of the substrate to be processed or cut by such peening ball or particle.
2. The peening ball or particle has lower fracture strength and toughness, thereby being easily broken after peening and unsuitable for recycling use.
3. The shot peening, when performed by wet process, will increase the difficulty for treating the processing sludge waste, thereby affecting the environmental protection.
4. Due to the easy breakage or damage of the peened substrate, it may reduce the productivity, and increase the production cost, thereby decreasing its commercial value.

The present inventor has found the drawbacks of the conventional peening process and invented the present cutting method with improved production efficiency and decreased production cost.

SUMMARY OF THE INVENTION

The object of the present invention is to provide a cutting method by applying a particle beam of metallic glass onto a substrate to cut or partially cut the substrate with high production efficiency, low production cost and better environmental protection.

DETAILED DESCRIPTION

Figure 1:
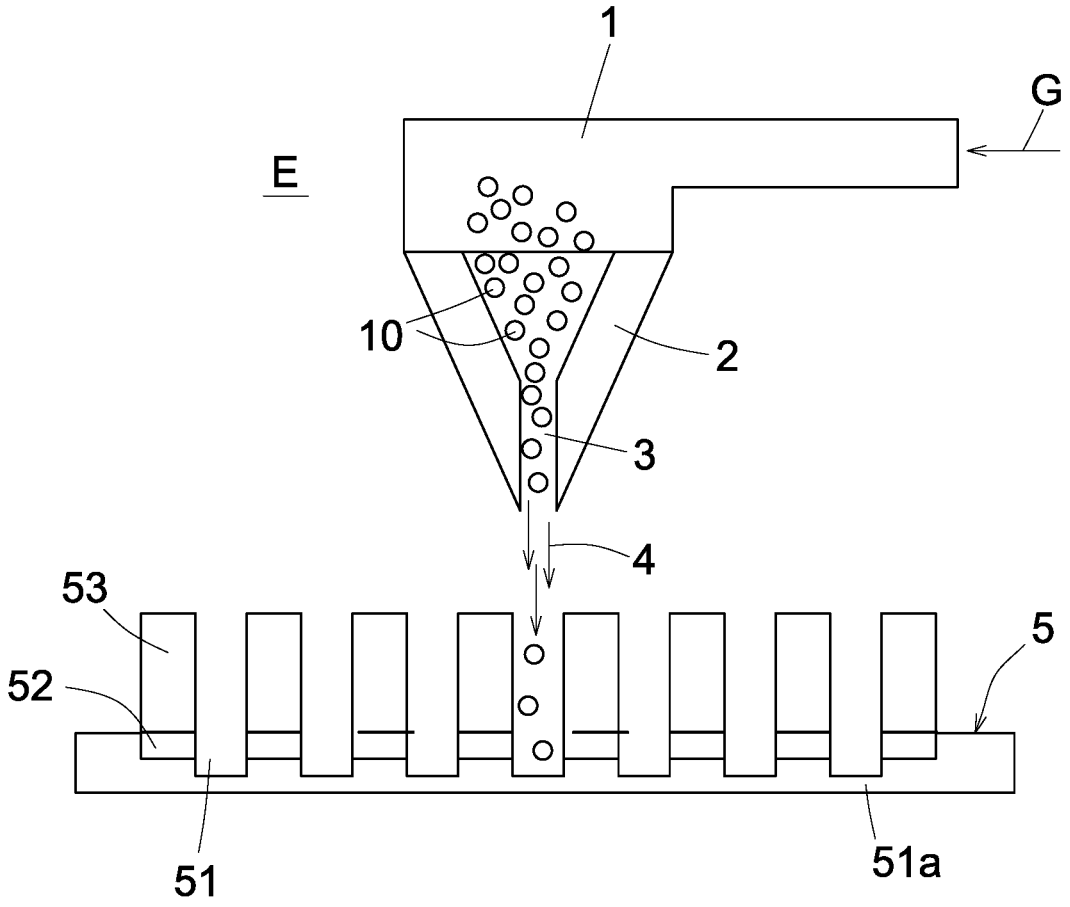
FIG. 1 shows an illustration of a first preferred embodiment in accordance with the present invention.
Figure 2:
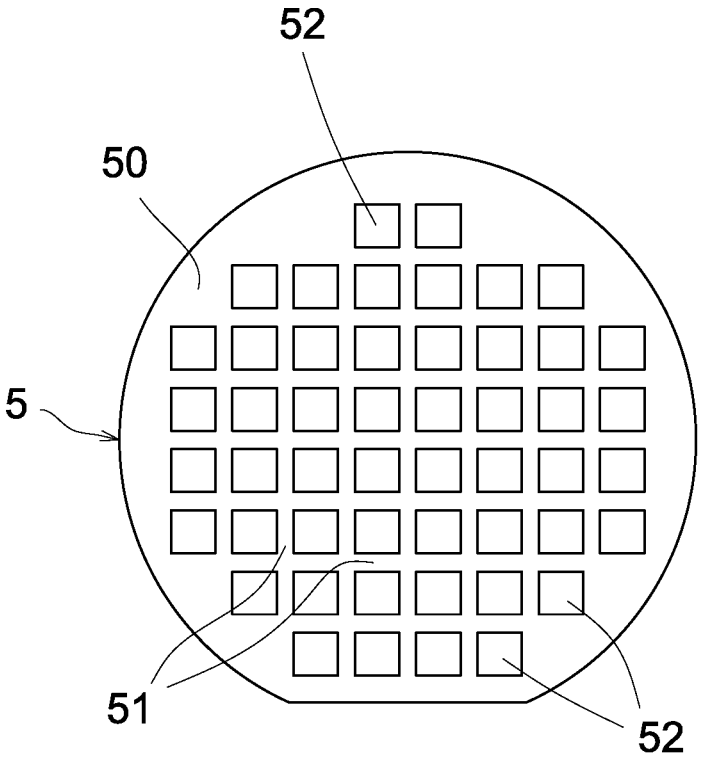
FIG. 2 is an illustration showing a wafer to be cut in accordance with the present invention.

As shown in FIGS. 1 and 2, a first preferred embodiment of the present invention discloses a cutting equipment, which comprises: a particle feeder 1 for feeding particles of metallic glass 10 to a nozzle 2 formed in a lower portion of the feeder 1, an ejection barrel 3 formed on a bottom portion of the nozzle 2 to eject the particles of metallic glass 10 downwardly to form a particle beam 4 to impact against a substrate 5 as boosted by a driving gas G which includes: air or inert gas such as nitrogen or argon.

The particle feeder 1 and the substrate 5 are subjected to a negative pressure environment E, such as being equipped within an enclosed chamber which is evacuated to form a negative-pressure environment.

The pressure of the driving gas may be set to a range of 0.1 bar to 5 bars, but not limited in the present invention.

The particle size of the metallic glass may be 1~100 microns for a precise cutting operation.

The metallic glass may be selected from: iron-based metallic glass, or nickel-based, cobalt-based metallic glass, or metallic glass with high-entropy alloy.

The substrate 5 may be a wafer having a plurality of chips 52 arranged as array and disposed on the substrate 5. After being impacted by the particle beam 4 of metallic glass, a plurality of cutting channels 51 will be formed on the substrate 5 so that each chip 52 is surrounded and defined by a plurality of cutting channels 51 as shown in FIG. 2. Each cutting channel 51 is depressed downwardly from the substrate 5 to remain a thin bottom layer Sla (FIG. 1) to link the neighboring chips 52 together, without being broken and separated. During the impacting or bombardment of the particle beams 4 of metallic glass onto the substrate 5, each chip 52 is covered by a mask 53 for protection of the chip. After cutting (impacting) by the metallic glass, scraps 50 will be formed as shown in FIG. 2. The chip 52 includes semiconductor chip, LED chip, etc.

The above-mentioned impacting of particles of metallic glass onto the substrate 5 may be defined as a cutting operation. Such a cutting is not performed to completely cut the substrate 5, namely, a thin bottom layer Sla is still maintained (FIG. 1). This may help a reliable and safer transfer of the chips 52 disposed on the "partially cut" substrate 5 for further processing of the chips 52. After transferring the chips 52 for further processing, the chips 52, which are previously linked and not cut completely, will then be completely broken and separated along the cutting channels 51.

Otherwise, if the chips 52 have been completely cut during the impacting (cutting) operation, the separated chips 52 will be difficultly handled for further processing such as packaging of the chips.

In the present invention, the particle beam of the metallic glass is forcibly driven by the gas under pressure of 0.1~5 bars to bombard or impact the substrate to plastically depress the substrate to form a plurality of cutting channels 51, adapted to define a plurality of chips 52 to allow each chip 52 to be surrounded by plural cutting channels 51, thereby reliably smoothly helping the subsequent processing of the chips.

Thanks to the good properties of the metallic glass particle 10 as used in this invention, namely, the properties of small particle size, high hardness, high density, and high true roundness. The impacting particle of metallic glass with its high dynamic bombardment energy will focusingly depress the substrate to form the plurality of cutting channels 51, which are beneficial for further cutting and separating of the chips 52. The metallic glass particles have a high breaking strength and will not be broken easily so that the metallic glass particles will be recycled and reused for saving cost and for better environmental protection.

The thickness of the thin bottom layer 51*a* may range from 0.02 mm to 0.1 mm, but not limited in this invention.

The depth of the cutting channel 51 may be set or adjusted by varying the parameters, including: impacting velocity, impacting distance, impacting angles, impacting time and the production capacity of metallic glass particles. By the way, each cutting channel 51 may be formed to have a precise depth, only remaining a thin bottom layer 51*a* adapted for easily peeling and separation of each chip 52 from the substrate 5. The thin bottom layer 51*a* may link neighboring chips 52, without being completely broken or separated, so as to help a smooth reliable transferring of the chips 52 for their further processing. When later processed, each thin bottom layer 51*a* may be peeled and broken in order to separate the chips 52.

Figure 3:
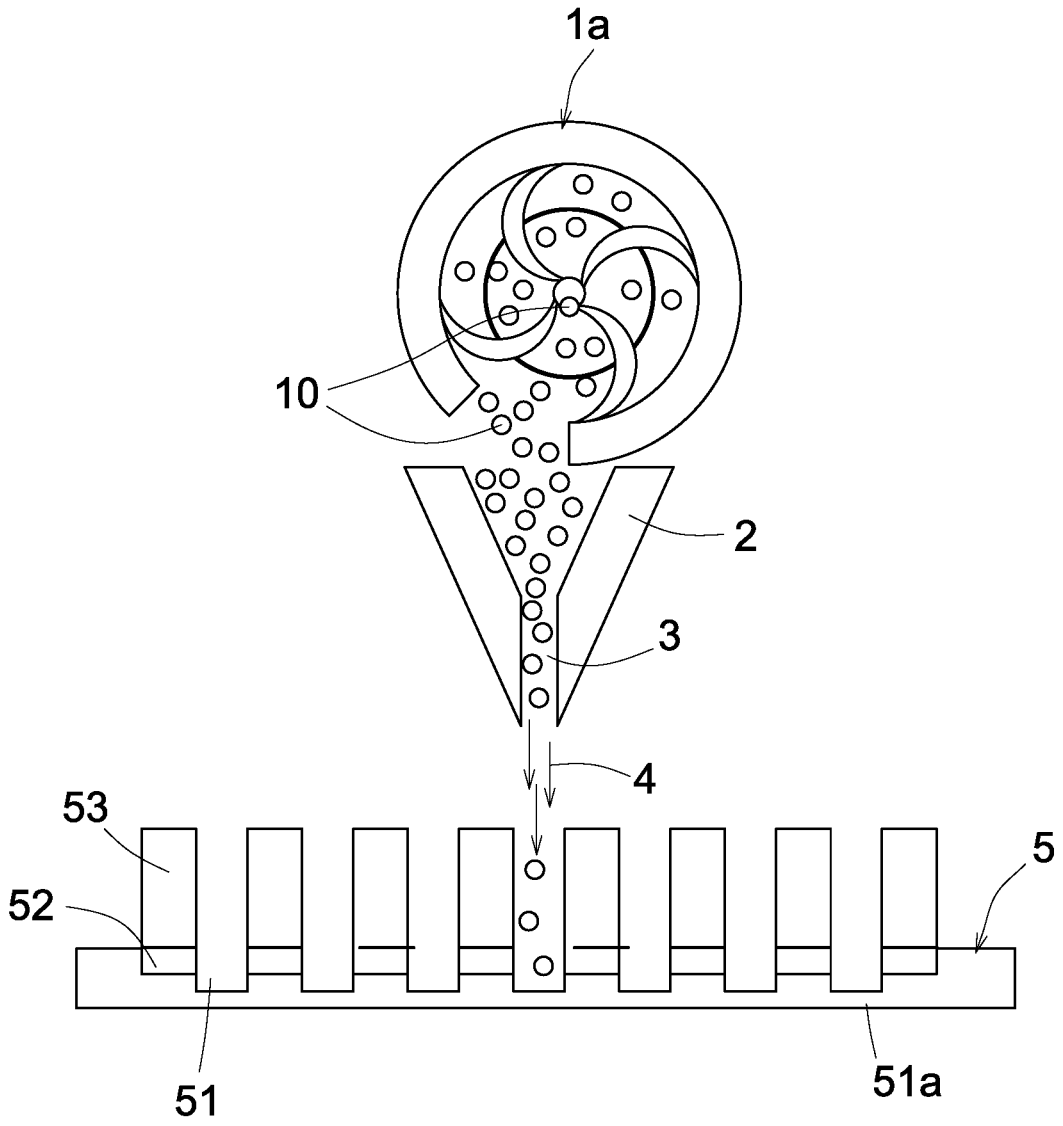
FIG. 3 shows a second preferred embodiment in accordance with the present invention.

As shown in FIG. 3, the particle feeder has been modified to be a centrifugal particle feeder 1*a*. Through such a centrifugal particle feeder 1*a*, the particles 10 may be centrifugally thrusted to impact the substrate 5 to form the plurality of cutting channels 51, having each thin bottom layer 51*a* linking the neighboring chips 52.

Figure 4:
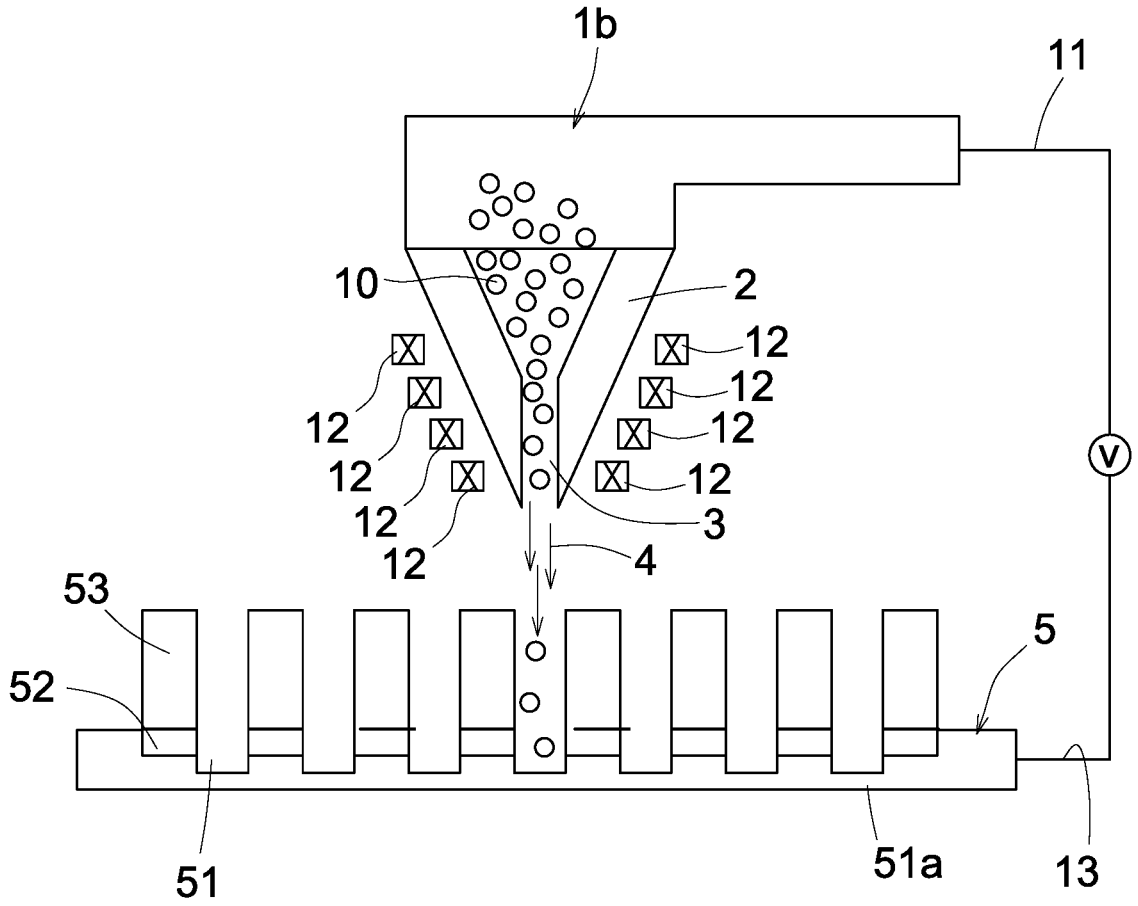
FIG. 4 shows a third preferred embodiment in accordance with the present invention.

As shown in FIG. 4, another particle feeder 1*b* is made to include a first electrode 11 and a second electrode 13 connected to form an electric circuit having electric current supplied thereto and forming a voltage V across the first electrode 11 and second electrode 13 to thereby produce charged particles of metallic glass 10 between the two electrodes 11, 13. The first electrode 11 is formed on an upper stream of particles 10 entering the feeder 1*b*, while the second electrode 13 is formed on the substrate 5 opposite to the first electrode 11. At least an electromagnetic coil 12 is provided to surround the nozzle 2 and ejection barrel 3 for further accelerating the charged particles 10 to form strong particle beams 4 downwardly to boost their bombardment against the substrate 5 to form the plurality of cutting channels 51.

Other particle feeders 1 may be further modified to boost the particle beams to efficiently cut the channels 51 in the substrate 5.

The present invention is superior to the conventional shot peening processes with the following advantages:

1. Due to the high hardness and high true roundness of the metallic glass particle, it will not cause unexpected breakage even small crackle of the substrate, thereby preventing from uncontrolled breakage of the wafer to be cut.
2. The particles of metallic glass may be used for a large cutting area when cutting a substrate (including wafer) to enhance the cutting efficiency.
3. After "partial cutting" of the substrate (wafer), the thin bottom layer 51*a* linking the neighboring chips may help a safe smooth and reliable transferring of the partially-cut wafer for further processing. Then, the chips may be easily peeled and separated from the partially-cut wafer, just by breaking each thin bottom layer 51*a*. So, the productivity and commercial value will be greatly increased.
4. This method is especially suitable for cutting mini or micro LED for shortening cutting time and facilitating the mass transferring of LED chips for further processing.
5. No wet process is used. No corrosive chemical, such as hydrofluoric acid, is used. So, no pollution hazard will be incurred, better for environment protection.

The present invention may be further modified without departing from the spirit and scope of this invention.

The invention claimed is:

1. A method comprising:

driving at least a particle beam composed of particles of metallic glass from a particle feeder to impact or bombard a substrate up to a depth in the substrate;

wherein said substrate is a wafer; and the particle beam is applied to bombard the substrate up to a depth to form a plurality of channels to define a plurality of chips, having a thin bottom layer formed among plural neighboring chips for linking the chips; and each said chip is covered with a mask for protecting said chip during bombarding operation; and wherein said thin bottom layer as formed in said substrate is adapted for a reliable transferring of said substrate, whereby upon peeling and breaking of each said thin bottom layer, said chips may be easily separated one another for further processing; and wherein said particle beam of particles of metallic glass is driven by a centrifugal particle feeder for centrifugally boosting the particle beam to impact the substrate up to a depth, maintaining said thin bottom layer in said substrate.

2. A method comprising: driving at least a particle beam composed of particles of metallic glass from a particle feeder to impact or bombard a substrate up to a depth in the substrate;

wherein said substrate is a wafer; and the particle beam is applied to bombard the substrate up to a depth, to form a plurality of channels to define a plurality of chips, having a thin bottom layer formed among plural neighboring chips for linking the chips; and each said chip is covered with a mask for protecting said chip during bombarding operation; and wherein said thin bottom layer is adapted for a reliable transferring of said substrate, whereby upon peeling and breaking of each said thin bottom layer, said chips may be easily separated one another for further processing, and wherein said particle beam is driven by the particle feeder; and a first electrode connected to an upstream of said feeder; a second electrode connected to said substrate opposite to said first electrode; an electric circuit connected between said first electrode and said second electrode, whereby when said electric circuit is conducted, a voltage is formed between said first electrode and said second electrode for forming charged particles of metallic glass between said first electrode and second electrode; and at least an electromagnetic coil surrounding said feeder for accelerating the charged particles towards a downstream of said feeder for impacting said substrate up to a depth, maintaining a thin bottom layer in said substrate.

3. A method according to claim 1, wherein said chip comprises: semiconductor chip, computer chip, LED chip, mini LED chip, and micro LED chip.

4. A method according to claim 2, wherein said chip comprises: semiconductor chip, computer chip, LED chip, mini LED chip, and micro LED chip.

* * * * *